US005834066A

United States Patent [19]

Künzli et al.

[11] Patent Number: 5,834,066

[45] Date of Patent: Nov. 10, 1998

[54] SPRAYING MATERIAL FEEDING MEANS FOR FLAME SPRAYING BURNER

[75] Inventors: Franz Künzli, Wangen/Dübendorf, Switzerland; Erwin Hühne, Schallstadt, Germany

[73] Assignee: Hühne & Künzli GmbH Oberflächentechnik, Schallstadt, Germany

[21] Appl. No.: 682,246

[22] Filed: Jul. 17, 1996

[51] Int. Cl.[6] ..... C23C 4/12

[52] U.S. Cl. ..... 427/446; 239/79; 239/81

[58] Field of Search ..... 427/446; 239/79, 239/81, 83, 85

[56] References Cited

U.S. PATENT DOCUMENTS 4,964,568 10/1990 Rotolico et al. ..... 239/8

5,165,705 11/1992 Huhne ..... 239/79

5,520,334 5/1996 White ..... 239/85

*Primary Examiner*—Katherine A. Bareford

*Attorney, Agent, or Firm*—Anderson, Kill & Olick, P.C.

[57] ABSTRACT

A method of operating a flame spraying burner, having water-cooled combustion chamber and expansion nozzle arranged downstream of the combustion chamber, with a gaseous fuel and/or a liquid fuel in association with an oxidation gas, a compression air and/or oxygen, and feeding a spraying material alternatively axially through the combustion chamber into the flame jet or radially, transverse to the burner axis, through at least two opposite radial bores which introduce the spraying material into the expansion nozzle; and a flame spraying burner operated by such a method.

42 Claims, 10 Drawing Sheets

SPRAYING MATERIAL FEEDING MEANS FOR FLAME SPRAYING BURNER

BACKGROUND OF THE INVENTION

1. Field of the Invention

The present invention relates to a universal high-speed flame spraying burner, which uses wire-shaped, rod-shaped and/or powdery spraying material, and to a method of operating the burner.

2. Description of the Prior Art

Flame spraying burners are generally known. Conventional flame spraying burners use only gaseous fuel or only liquid fuel, e.g., kerosene. Further, in vast majority of conventionally used flame spraying burners, feeding of powdery, wire-shape or rod-shape spraying material is effected axially from the rear of a burner. It has to be pointed out that while in flame spraying burner operating on a pure kerosene, feeding of the powdery or wire-shaped spraying material is effected sidewise, an axial feeding is used when a high-melting spraying material is used because, as known, axial feeding from the rear results in a faster melting. The axial feeding in this case is used to obtain a high-quality spraying. Still further, in conventional gas-operated flame spraying burners, the ratio of the kinetic energy to the thermal energy is negative. The kinetic energy is higher when a liquid fuel is used for operating a burner. At high temperature, the heat is transmitted to the outer surface. This leads to crack formation in the coating.

Accordingly, an object of the invention is to provide a universal high-speed flame spraying burner having all of the advantages of the conventional gas-operated burner and, in addition, capable of producing a high-quality coating layer which can presently be produced only by operating a burner with a liquid fuel such as methane, kerosene, diesel fuel, etc. . . . in combination with oxidation gas, oxygen and compression air.

Another object of the invention is a flame spraying burner in which feeding of the wire-shaped, rod-shaped or powdery spraying material can be effected alternatively or simultaneously with mixing of liquid and gaseous fuels with oxidation gases necessary for combustion.

Yet another object of the invention is a flame spraying burner capable of using all of the wire-shaped, rod-shaped or powdery spraying materials, including a filler wire and sheathed wire, formed, e.g., from:

pure metals, metal-bound carbide, chromium carbide, titanium carbide, etc.

mixtures of metal carbides, ceramic spraying materials and their mixtures, and mixtures of ceramic and non-ceramic materials, MCr AIY's NiCr AIY, CoCr AIY, NiCoCrAIY) spraying materials).

A further object of the invention is a flame spraying burner that would combine advantages of both kerosene-operated and gaseous fuel-operated burners.

A still further object of the invention is a method of operating a flame spraying burner according to the present invention which would insure a trouble-free coating process, together with obtaining of optimal parameters of the coating.

SUMMARY OF THE INVENTION

These and other objects of the present invention, which will become apparent hereinafter, are achieved by providing a flame spraying burner including a water-cooled combustion chamber, a rear connection block for delivering operating media to the combustion chamber, an injection block located downstream of the rear connection block and upstream of the combustion chamber for mixing the operating media components and for injecting the operating media component mixture into the combustion chamber, a water-cooled expansion nozzle located downstream of the combustion chamber and means for feeding a spraying material into a center of a flame jet passing through the nozzle and comprising means for feeding the spraying material axially through the rear end block and through the combustion chamber and/or means for delivering the spraying material radially, transverse to a longitudinal axis of the burner and including at least two opposite radial feeding bores located downstream of the combustion chamber in a spraying direction.

The injection block in the flame spraying burner according to the present invention insures the use of all presently known non-poisonous, technical, gaseous and liquid fuels in association with oxidation gases including oxygen and compressed air for the HVOF-spraying process. The selection of an appropriate fuel-oxidation substance mixture, together with cooling and protective gases, is effected taking into the consideration the properties of respective used spraying materials.

A particular feature of the present invention consists in that the most important functional parts of the flame spraying burner are designed in accordance with the modular principle for easy assembly of the burner, and are selected in accordance with specific parameters of the coating process and the used spraying material.

According to a preferred embodiment of the present invention, the expansion nozzle has a two-stage bore, with the stages being connected by a transition region and with the radial feeding bores opening into the transition region. The radial feeding bores are formed in a tightening disc secured between a flange of an outer water jacket, associated with the expansion nozzle, and a flange ring of an outer screw sleeve associated with the combustion chamber.

According to a further development of the invention, the expansion nozzle is provided, in its region in which the radial bores open into the nozzle bore with a collar. The tightening disc is supported on the collar, and the collar is provided with axial channels, through which cooling water flows to prevent heat transfer to the tightening disc. Soft sealing elements, preferably O-rings, are provided on opposite sides of the radial feeding bores in a contact area of the tightening disc with the collar. During the operation, the circulating cooling water prevents the overheating of the soft sealing elements.

According to the invention, when the burner is operated on a mixture of a gaseous fuel with oxygen, feeding of the spraying material can alteratively be effected either through the radial feeding bores or axially through the combustion chamber when a high-melting spraying material is used.

According to the invention, the injection block, which is used when a liquid fuel is used for operating the burner, is provided with metering bores for the liquid fuel.

The starting of the flame spraying burner according to the present invention is effected as follows. Hydrogen, which is used as a pilot and ignition gas, is injected through the rear end block connector, which is normally used for the axial feeding of a spraying material, by means of per se known safety cutout with gas back flow preventing means. The hydrogen is injected into the combustion chamber with a flow pressure of about 8–15 bar at a rate (during the pilot phase) of about 50–100 l/min. Oxygen is fed through another connector of the rear end block by means of per se known explosion-proof device with gas back flow preventing means. The oxygen is injected with a flow pressure of about 15 bar at a rate of 25–50 l/min. The hydrogen and oxygen mix with each other in the combustion chamber. The hydrogen-oxygen mixture flows through the bore of the expansion nozzle and is electrically ignited as it exits the nozzle mouth. Because of a relatively low flow speed of the mixture in the nozzle bore and a high speed of ignition, the hydrogen-oxygen flame flashes back into the combustion chamber. During this operational phase, simultaneously a powder carrying gas, nitrogen or argon, is fed through the radial feeding bores into the second stage of the nozzle bore. During the following operational step, large amounts of hydrogen and oxygen are fed into the combustion chamber to obtain a high-speed hydrogen-oxygen flame, which is ejected from the nozzle mouth. During this step, about 30–60 $m^3$ of oxygen and about 15–30-$m^3$ of hydrogen flows through the combustion chamber.

Then, a liquid fuel, primarily kerosene, is injected at a pressure of about 8–15 bar and at a rate of 0.3–0.8 l/min.

At these parameters, optimal mixing of the kerosene with oxygen in the combustion chamber and the kerosene atomization is insured. The finely atomized kerosene-oxygen mixture immediately ignites, leading to extreme gas expansion and rapid increase in temperature. Thereby, a hypersonic flame jet with an energy of about 200–400 kw leaves the expansion nozzle mouth. Under normal conditions, at that time, the feeding of hydrogen is cut off, and a high energy kerosene-$O_2$-HVOF-flame is produced. Then, the spraying material is injected into the nozzle bore and into the flame jet. The spraying material is melted there and is applied by the kerosene-oxygen jet, which has an extremely high kinetic energy and a velocity of about 1,500–2,000 m/sec, onto a surface, e.g., of a substrate. This results in the formation on the substrate surface of a dense, optimally adhesive layer having a very small porosity. The HVOF-spray layers obtained with a flame spraying nozzle according to the present invention are characterized by a compression stress and, therefore, are not susceptible to cracking. The kerosene-oxygen flame is primarily used for obtaining metal-bonded hard material coating layers, such as spray coating layer from pure metals.

Spraying of high-melting spraying materials, e.g., molybdenum of ceramics, with the flame spraying burner according to the present invention is then possible, when a high energy combustion gas, e.g., hydrogen or methane, is added to the kerosene-oxygen flame in order to increase the thermal energy of the flame to a degree which makes melting of the high-melting materials possible. Obviously, the HVOF-spraying process is accompanied by water-cooling of both the combustion chamber and the expansion nozzle. According to the invention, the cooling water is delivered and discharge through appropriate connectors provided in the rear end block. The cooling water should be mineral-free. The cooling water absorbs from about 20 to 30% of the thermal energy during the spraying process.

According to a particular advantageous embodiment of the present invention, a water-cooled wear-resistant tube is provided in the flame spraying burner for central feeding of the spraying material. The tube projects into the combustion chamber and extends up to 7–8 mm before the nozzle inlet. The cooling system provides for optimal cooling of the injection components which extend into the combustion chamber. A short distance between the end of the feeding tube and the nozzle inlet insures that the spraying material, which is centrally supplied in a powder form, crosses this distance, without particles being deposited onto the end surface of the combustion chamber. Such deposit would have adversely affected the operation of the combustion chamber. Further, the short distance that the spraying material has to cross in the combustion chamber prevents overheating of the material or its overmelting and prevents an undesirable oxidation and phase change.

According to a further advantageous embodiment of the flame spraying burner according to the present invention, it is provided with a two-stage large-volume combustion chamber, insuring that the burner can be operated with all technically combustible gaseous and liquid fuels. The feeding of the spraying material, which can be in wire-shaped, rod-shaped or powdery form, can be fed alternatively axially or radially through the radial feeding bores. The two-stage large volume combustion chamber permits to operate the burner with gaseous fuels, in combination with compressed air or oxygen, which have ignition and combustion velocity comparable with those of hydrogen and acetylene, e.g., with city gas, methane, butane, natural gas, and a methane-butane mixture.

According to a further development of the invention, the rear end block is provided with an additional connector for delivering of a cooling or protective gas to the combustion process during combustion of fuel-oxidation gas mixture in order to be able to vary the combustion temperature and other parameters of the combustion process which affect the quality of the coating layer.

According to a further preferred development of the present invention, a spark plug is provided in the center of the injection block. A flame spraying burner with a spark plug should have a two-stage combustion chamber with radial feeding of the spraying material. With such a flame burner, when it is operated with fuel in combination with oxygen or compressed air, the mixture is ignited by a spark in the combustion chamber at the start of the operation. Because the ignition takes place directly in the combustion chamber, when a liquid fuel is used in combination with oxygen or compressed air, no hydrogen-oxygen pilot flame is necessary. E.g., the kerosene-oxygen mixture can be ignited in the combustion chamber.

According to a further development of the invention, these are provided an outer mixing block and a block support with an integrated pressure gas shroud. In this flame burner, different medium component are mixed outside of the block, e.g., in the combustion chamber. This modification permits to obtain specific characteristics of the coating (spray) layer.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
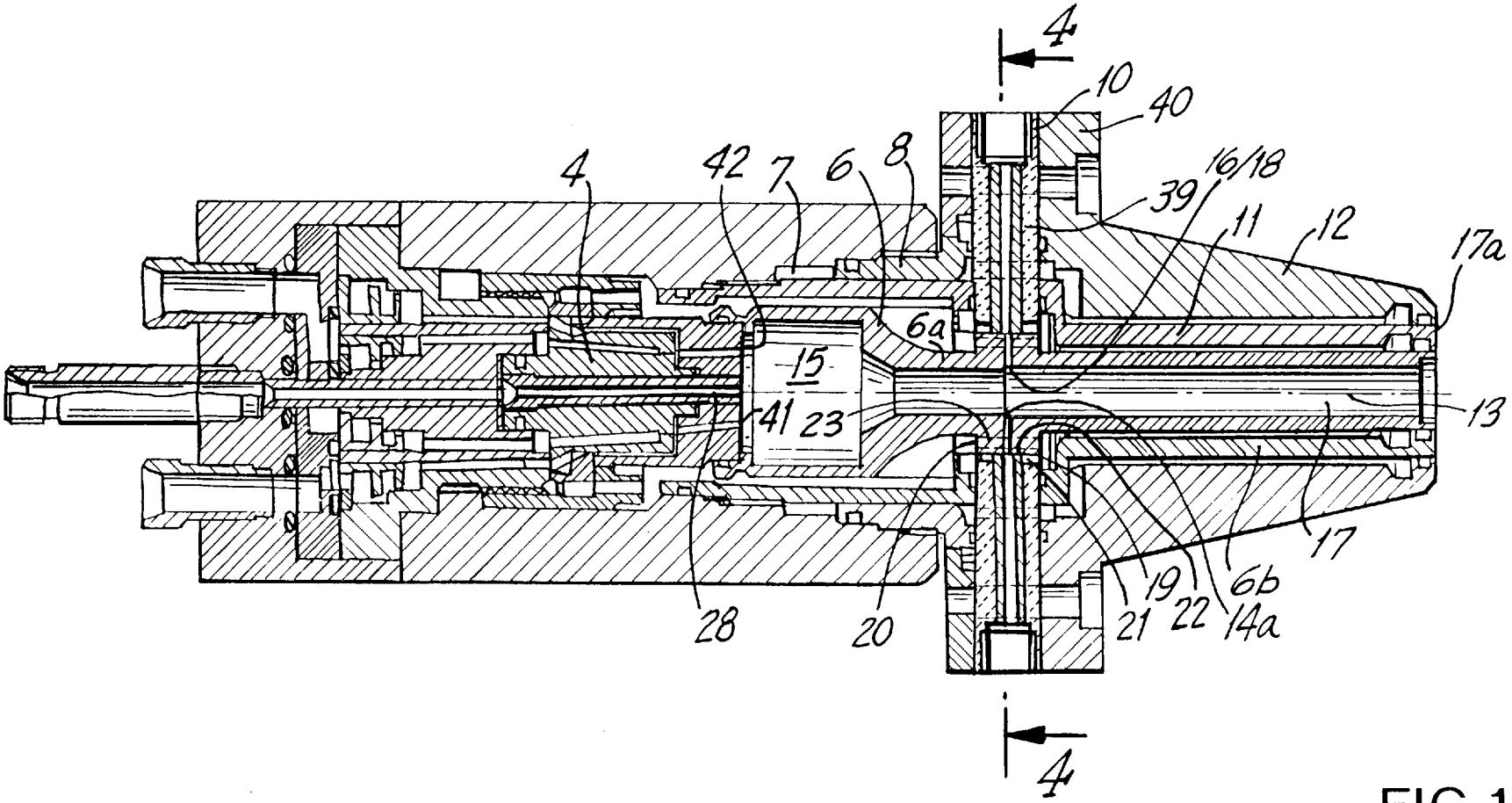
FIG. 1 is a longitudinal vertical cross-sectional view of a high-speed flame spraying burner according to the present invention.
Figure 2:
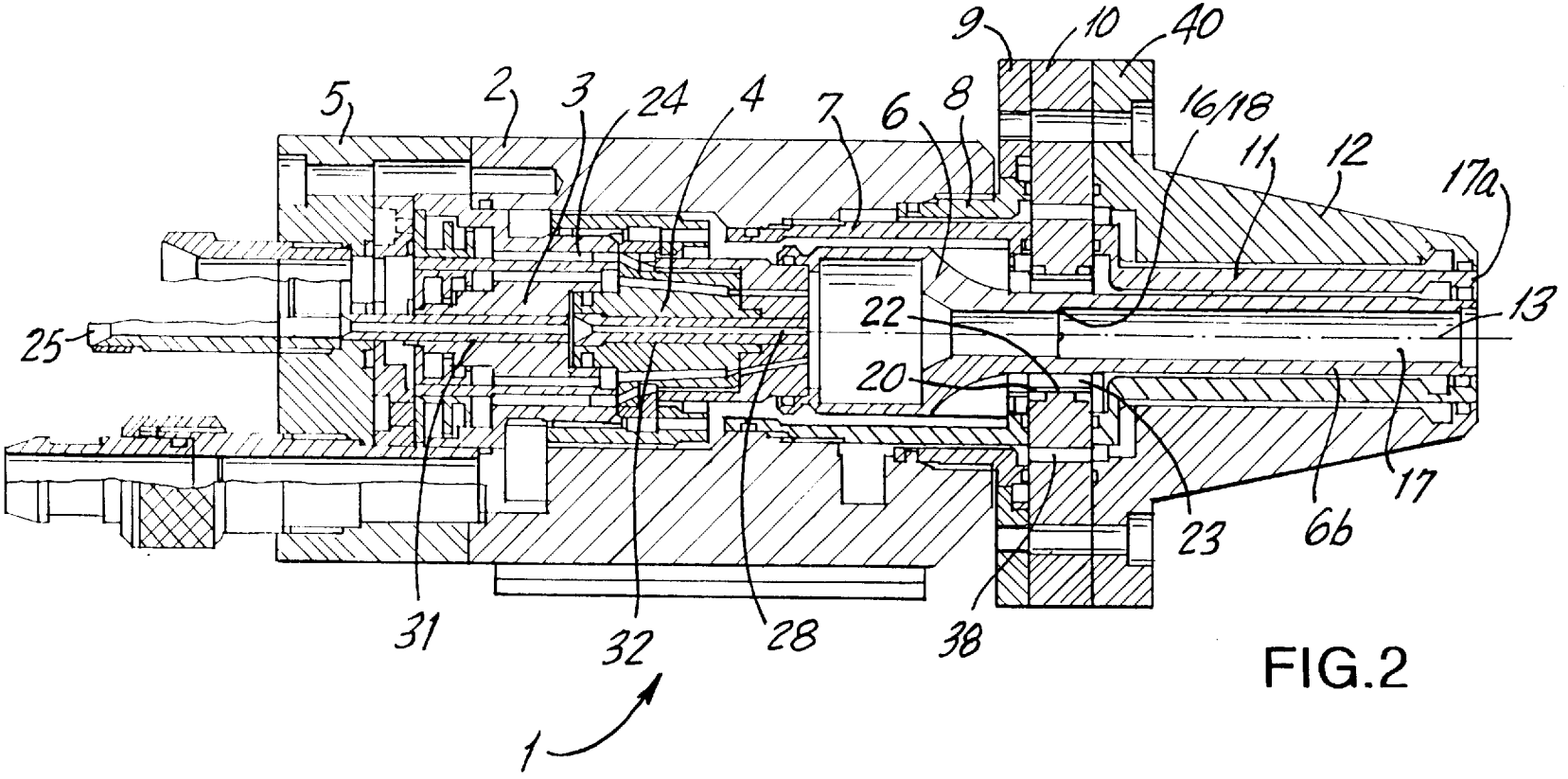
FIG. 2 is a further longitudinal cross-sectional view of the flame spraying burner according to the present invention.
Figure 3:
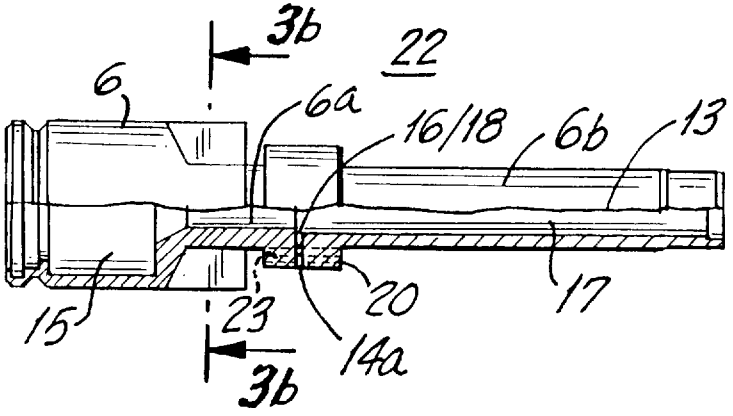
FIG. 3 is a longitudinal cross-sectional view of an expansion nozzle for the flame spraying burner according to the present invention.
Figure 3A:
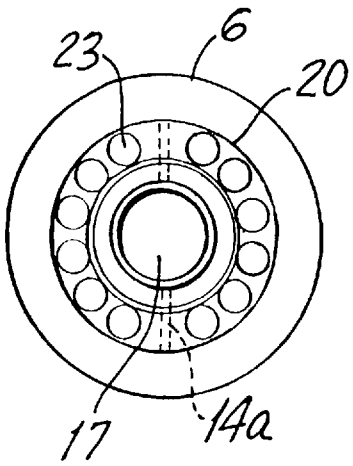
FIG. 3*a* is a cross-sectional view (at an increased scale) along line A—A in FIG. 3.
Figure 3B:
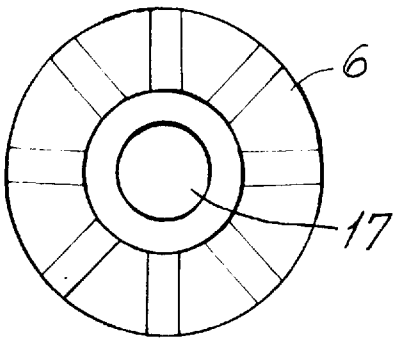
FIG. 3*b* is a cross-sectional view (at an increased scale) along line B—B in FIG. 3.
Figure 4:
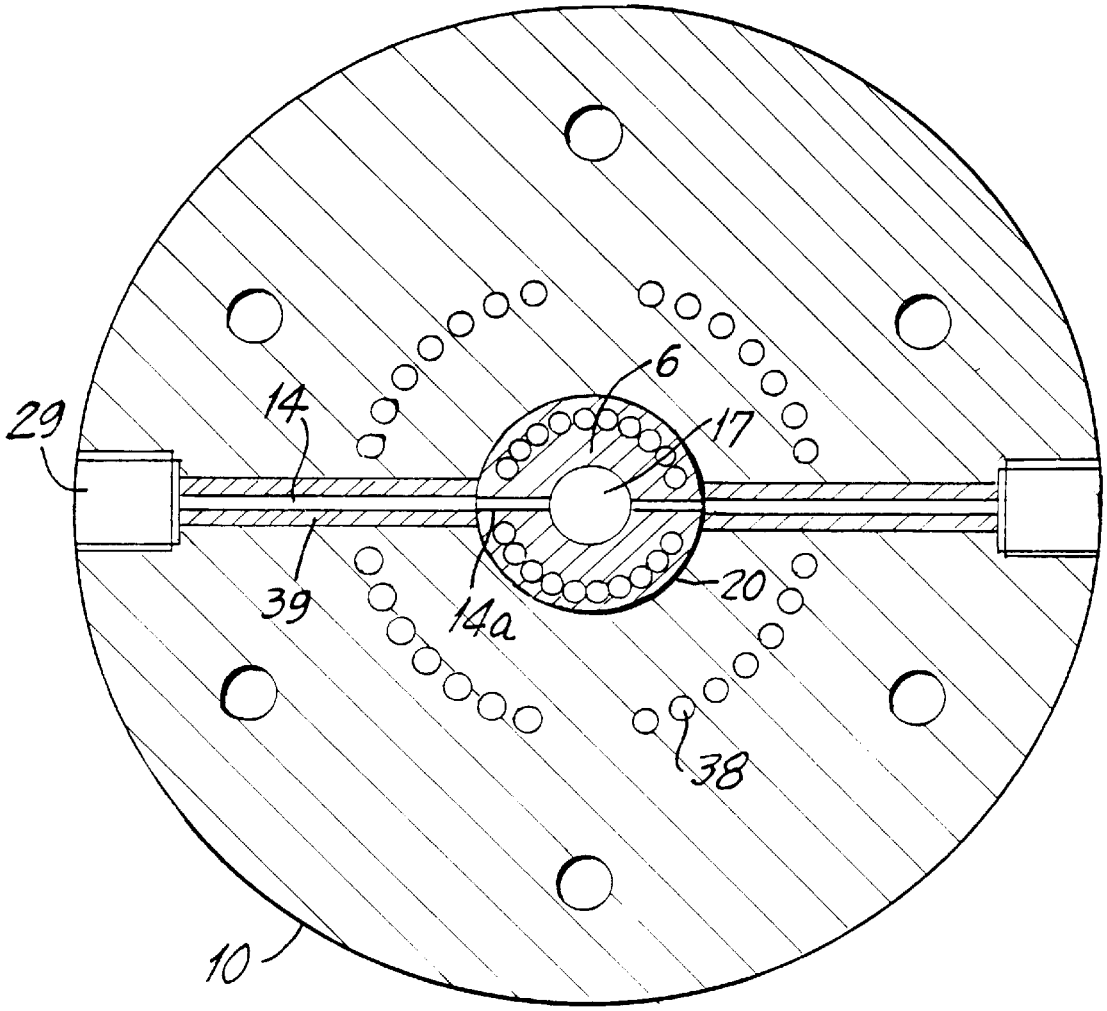
FIG. 4 is a cross-sectional view along line A—A in FIG. 1, together with a tightening disc.

The flame spraying burner 1 according to the present invention is characterized primarily by including a two-stage, water-cooled expansion nozzle 6 which is located downstream of the combustion chamber 15. Feeding of a spraying material is effected through radial bores 14 in a tightening disc 10 and channels 14*a* formed in the expansion nozzle. According to the invention, the feeding of the spraying material into the expansion nozzle 6 is effected in the transition region 16 between the two stages 6*a* and 6*b* of the nozzle 6. The transition region between the two stages 6*a* and 6*b* is formed by a step 18 which provides for widening of the stage 6*b* with respect to the stage 6*a*. In the region in which feeding of the spraying material is effected, the expansion nozzle 6 has a collar 20 on which the tightening disc 10 is supported. The collar 20 is provided with axial bores 23 for cooling water.

To enable radial feeding of powder or of a spray wire, the tightening disc 10 is provided. The tightening disc 10 has bores 38 for the cooling water and, as discussed above, with radial feeding bores 14. The tightening disc 10 is mounted and fixed between a flange ring 9 and a flange 40 of the outer screw sleeve 12.

The tightening disc 10 is sealed against the penetration of the cooling water at its contact surface 19 with the collar 20 of the nozzle 6 with soft sealing members 21, preferably in the form of O-rings, which are provided on opposite sides of the feeding bores 14. To prevent the transmission of heat from the heated outer wall of the expansion nozzle 6 and the tightening disc 10 along the contact surface 19 during the coating process, there are provided, according to the invention, in the tightening disc supporting collar 20, a plurality of the axial bores 23 for the cooling water. As a result, burning of the soft sealing members 21 is prevented.

When the flame spraying burner 1 operates on a gaseous fuel, it is fed in combination with oxygen, together with the spraying material through the radial bores 14 provided with respective connections 29. Alternatively, the combustion mixture can be fed axially through the combustion chamber 15 when the spraying material has a high melting point.

In particular cases, both feeding methods can be used for feeding the combustion mixture into the same flame spraying burner, either through the central bore 28, with the use of a connector 25 or through the connections 29 and radial feeding bores 14.

In the case when the burner operates on a liquid fuel, the burner, as shown in FIGS. 1, 2, 5, 6, 7, 9 and 10, is provided with an injection mixing block for mixing of the liquid fuel and the oxygen, with the injection mixing block being provided with metering bores 24 for the liquid fuel.

As shown in the drawings, the burner 1 has a housing 2 which surrounds an intermediate tightening screw sleeve 7 which forms a guide sleeve for the cooling water for cooling the combustion chamber. At side of the housing 2 adjacent to the expansion nozzle 6, there is provided an outer screw sleeve 8, the flange ring 9 of which, together with the outer jacket 12 or, more precisely, the jacket flange 40, enclose the tightening disc 10. The injection mixing block 4 is carried by a mixing block carrier 3. At the end of the housing 2 remote from the nozzle 6, there is provided an end block 5 with the operational instrumentation. The end block 5 is provided with connectors 25, 26 and 30. Feeding of the spraying material into the combustion chamber 15 can be effected through the feed channel 31 and the central bore 28.

A wear-resistant tube 32 is provided in the injection mixing block 4 which defines the central bore 28. According to the invention, the tube 32 can extend up to the bore 17 of the expansion nozzle 6. An inner water jacket 11 forms, together with the outer jacket 12, delivery and return channels for the nozzle cooling water.

Hydrogen, which is used as a pilot and ignition gas, is injected into the combustion chamber 15 through the connector 25 via a per se known safety cutout with gas back flow preventing means. During the pilot phase, the hydrogen is fed at a rate of 500–100 l/min with flow pressure from 8 to 15 bar. Oxygen is fed through the connector 26 via a per se known explosion-proof device with gas back flow preventing means at a rate of about 25–50 l/min with flow pressure of about 15 bar. The oxygen exits from injection block 4 into the combustion chamber 15 through the openings 41 and 42 and is mixed there with the hydrogen which is fed through the central bore 28. The hydrogen-oxygen mixture flows through the bore 17 of the expansion nozzle 6, and is electrically ignited as it exits the nozzle 6. Due to the small flow velocity in the bore 17 and high ignition speed of the pilot gas mixture, the hydrogen-oxygen flame flashes back into the combustion chamber 15.

Simultaneously, during the pilot phase, the spraying material is fed from opposite sides through the connections 29 in to the second stage 6*a* of the expansion nozzle 6 or into the bore 17. At that, nitrogen or argon is used as a powder carrier gas. Thereafter, a larger amount of hydrogen-oxygen mixture is fed, providing for a high-speed hydrogen-oxygen flame which exits the mouth of the expansion nozzle 6. At that time, a predetermined amount of hydrogen and oxygen, e.g., from 30 to 70 $m^3$ of oxygen and from 15 to 30 $m^3$ of hydrogen flows through the burner. Then, a liquid fuel, mainly kerosene, is fed through the connector 30 via a safety cutout with an integrated back flow preventing means. The kerosene is fed with a pressure of 8–15 bar. At a rate of about from 0.3 to 0.8 l/min, at which kerosene is fed into the combustion chamber 15, the kerosene is optimally atomized and mixes with the oxygen. The finely atomized kerosene-oxygen mixture, which exists through the opening 41 and 42, rapidly ignites leading to a large gas expansion and an extremely high rise in temperature in the combustion chamber 15, which is water-cooled from outside. A hypersonic flame jet with an energy from 200 to 400 kw exits from the nozzle bore 17 with a speed which exceeds the speed of sound in several times. Under normal conditions, the pilot gas, hydrogen, will be cut out, leading to a high-energy kerosene-oxygen-HVOF-flame. In the second stage 6*b* of the expansion nozzle 6, the spraying material is injected into the hypersonic flame torch from opposite sides, is melted there and, upon exiting the nozzle mouth, impacts, with an extremely high kinetic energy of the kerosene-oxygen flame jet at a speed of about 1500–2000 m/sec, on the outer surface of a substrat, forming thereon a dense, optimally bonded layer having a very small porosity. The so obtained HVOF-spray layers have a high compression stress and, therefore, not susceptible to fracture. With a pure kerosen-oxygen flame, primarily metal bonded, hard material layers, such as pure metallic spray layers, can be obtained. High-melting spraying materials, e.g., molibdenum and ceramics can be used with the flame spraying burner according to the present invention when into the kerosene-oxygen flame additionally a high energy fuel gas, such as hydrogen or methane, is added to increase the thermal energy of the kerosene-oxygen flame in order to melt the above-mentioned materials. During the HVOF-spraying process, obviously, the combustion chamber 15 and the expansion nozzle 6 are cooled within a closed cooling loop with cooling water. A demineralized cooling water is fed through the connector 30 and passes into the cooling system of the burner 1. The cooling water leaves the burner 1 through the connector 26. The connectors 30 and 26 are designated in FIG. 5*a* as "input" and "output". The cooling water absorbs from about 20 to 30% of the generated thermal energy during the HVOF process which becomes lost.

Figure 5:
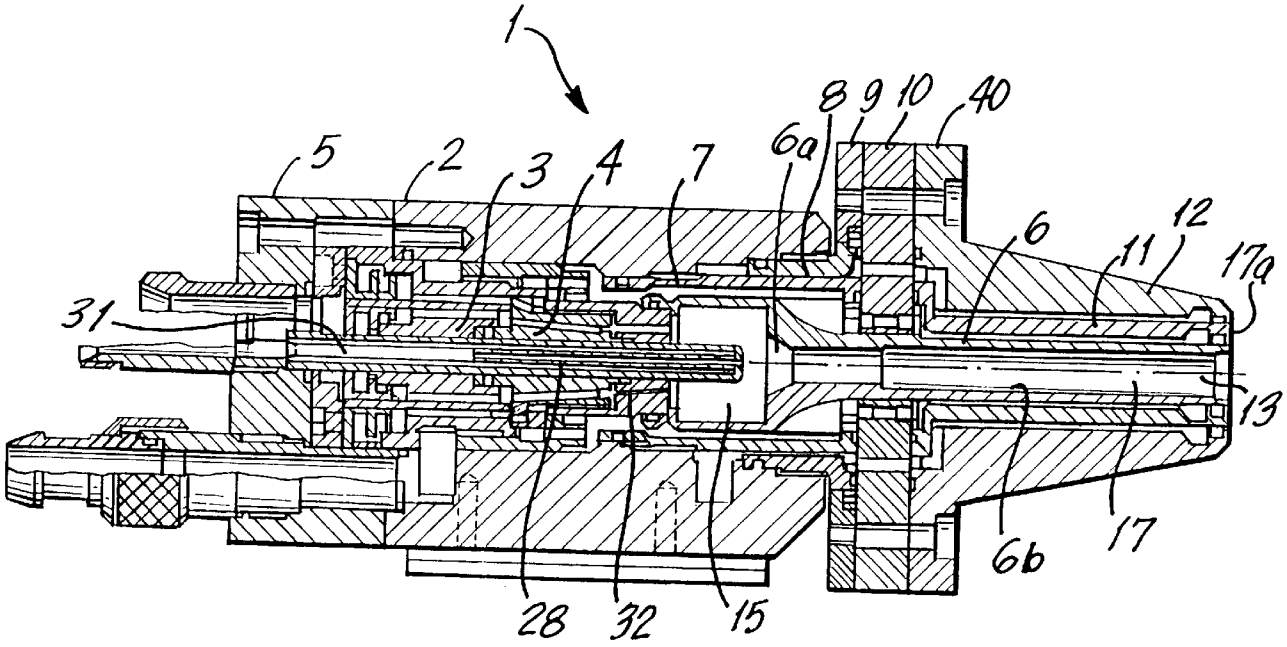
FIG. 5 is a longitudinal cross-sectional view of an embodiment of a flame spraying burner according to the present invention with a water-cooled powder insert extending into the burner combustion chamber.
Figure 5A:
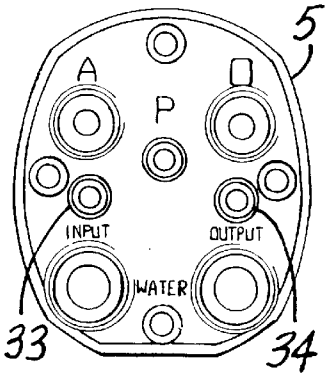
FIG. 5*a* is a view of the direction of arrow "A"

The flame spraying burner shown in FIG. 5 operates on all technical gases and liquid fuels in association with oxygen. The wear-resistant tube 32 serves for axial feeding of the spraying material into the combustion chamber 15. The tube 32 extends into the chamber 15 to about from 7 to 8 mm from the inlet of the stage 6*a* of the nozzle 6 and is water-cooled.

The end block 5, in addition to the standard connectors for feeding operational components, is provided with two additional separate connectors 33 and 34 for feeding and discharging of the cooling water for cooling the tube 32. The connectors 33 and 34 are so arranged that optimal cooling of the tube 15 is obtained. The advantage of the axial or central feeding of the spraying material primarily consists in that the powdery spraying material, after it exits the combustion chamber 15, has to cross only a very short distance to reach the nozzle bore 17 so that no material particles can deposit on the end surface of the combustion chamber 15 and stick thereto. The short distance, which the spraying material has to cross in the combustion chamber 15, prevents overheating or excessive meltdown of the spraying material as well as an undesirable oxidation and phase unbalance.

Figure 6:
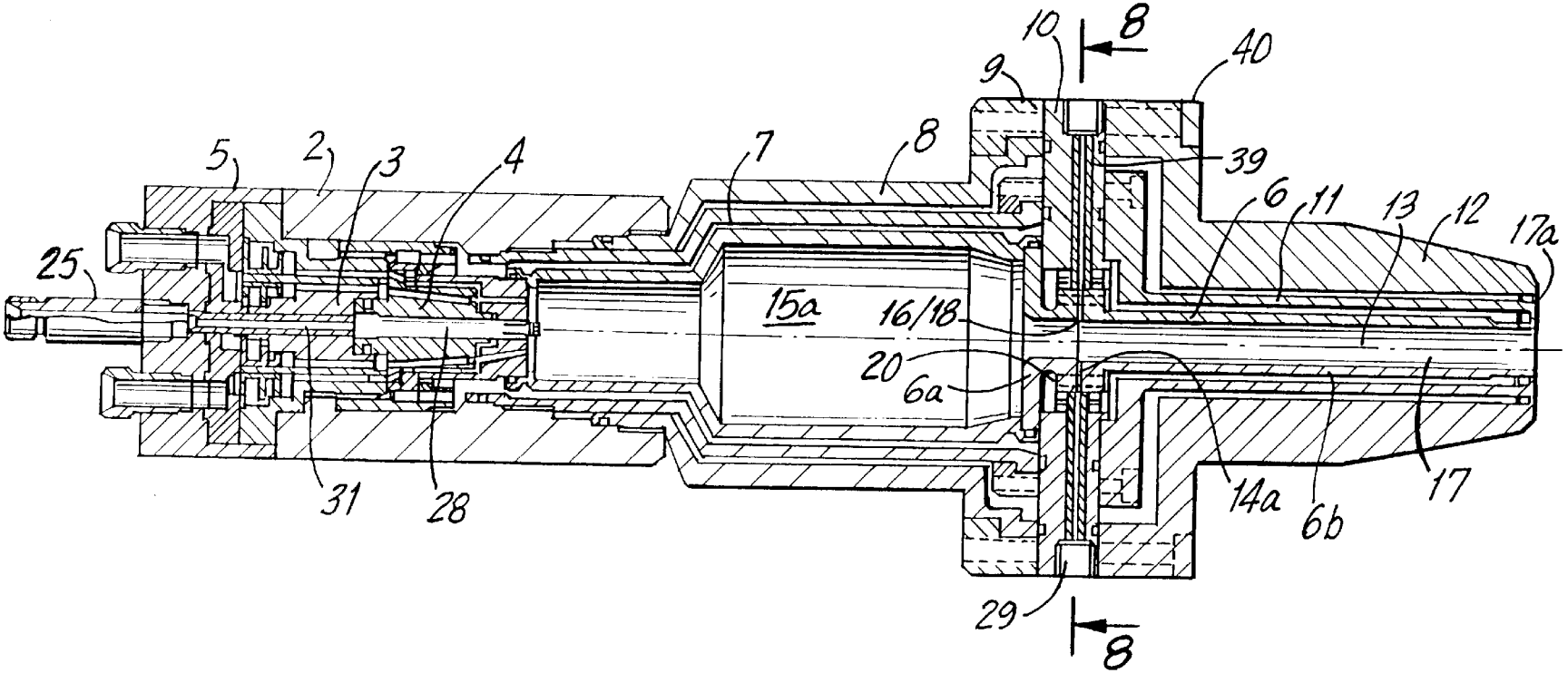
FIG. 6 is a horizontal longitudinal cross-sectional view of another embodiment of a flame spraying burner according to the present invention with a two-stage combustion chamber.
Figure 7:
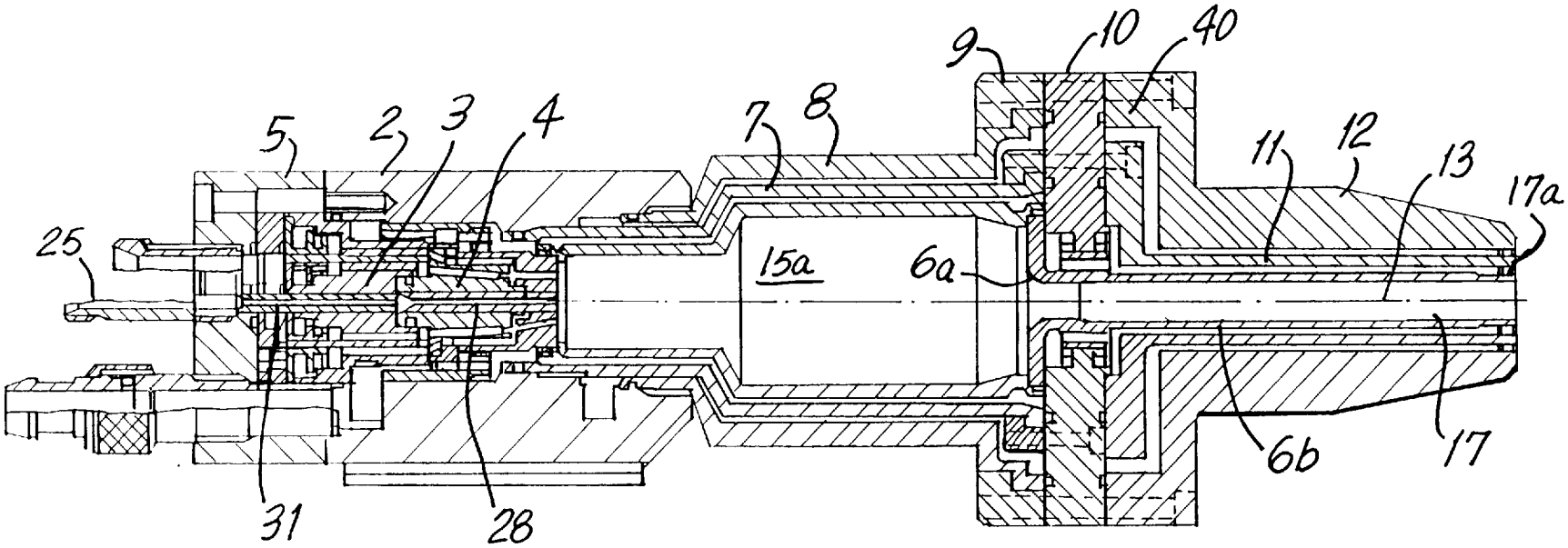
FIG. 7 is a longitudinal vertical cross-sectional view of the burner shown in FIG. 6.
Figure 8:
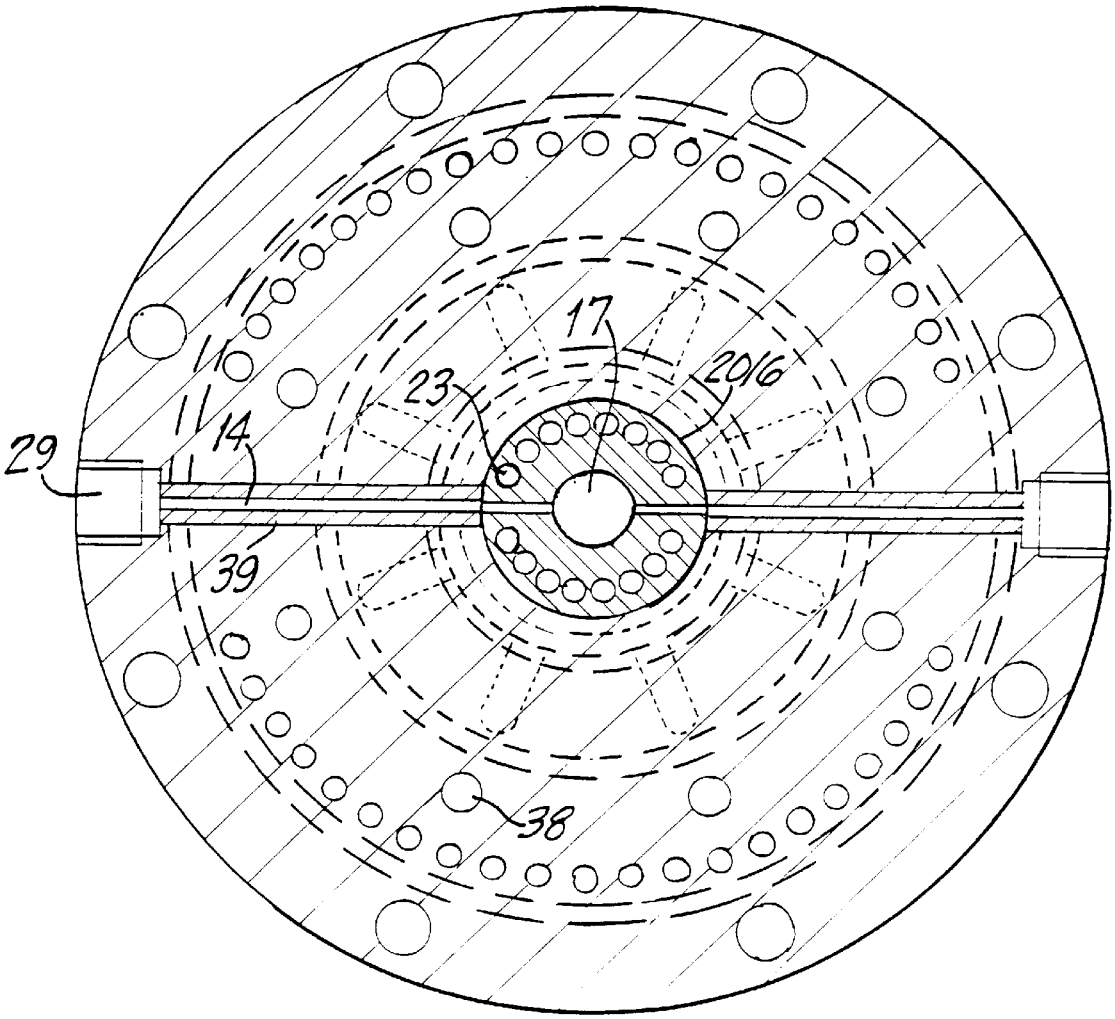
FIG. 8 is a cross-sectional view along line A—A in FIG. 6 with a tightening disc.

Yet another embodiment of a flame spraying burner according to the present invention is shown in FIGS. 6 and 7. The burner 1 shown therein has a two-stage large-volume combustion chamber 15 which likewise can operate on all technical fuel gases and liquids. The feeding of wire, rod or powder spraying additives can be effected selectively centrally through the chamber 15*a* or radially thereinto, transverse to the burner axis 13, through the radial connections 29 of the nozzle 6. The large volume of the chamber 15 permits to operate the burner with such fuel gases, together with oxygen, which have, in comparison with hydrogen or acetylene, lower ignition and combustion speed, e.g., with town gas, methane-butane mixtures or natural gas.

Figure 9:
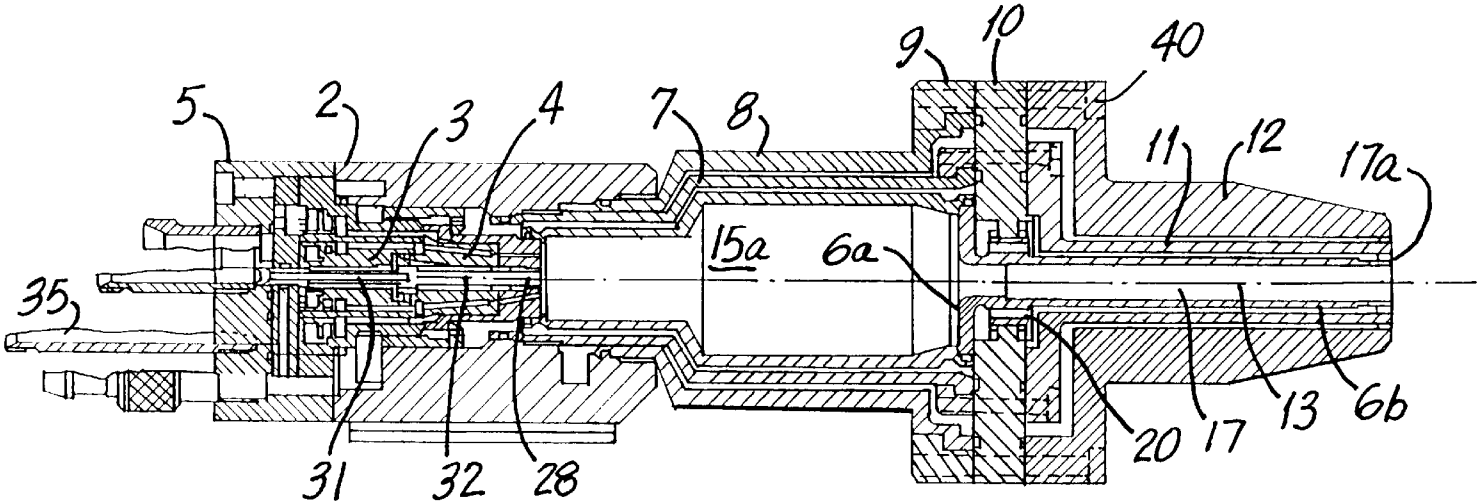
FIG. 9 is a cross-sectional view of a still further embodiment of a flame spraying burner according to the present invention with a two-stage combustion chamber and an auxiliary pressure gas connection.
Figure 9A:
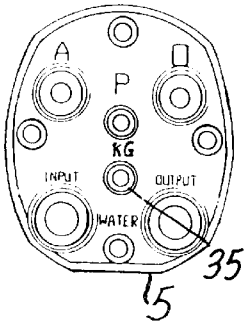
FIG. 9*a* is a view in the direction of arrow "A" in FIG. 9.

The embodiment of a flame spraying burner according to the present invention, which is shown in FIG. 9, is characterized by an additional connector 35 providing in the rear end block 5 for delivery cooling or protective gases into the combustion process when fuel oxidation gases are used, in order to vary the combustion temperature and other factors of the combustion process which can favorably influence the quality of a spray coating.

Figure 10:
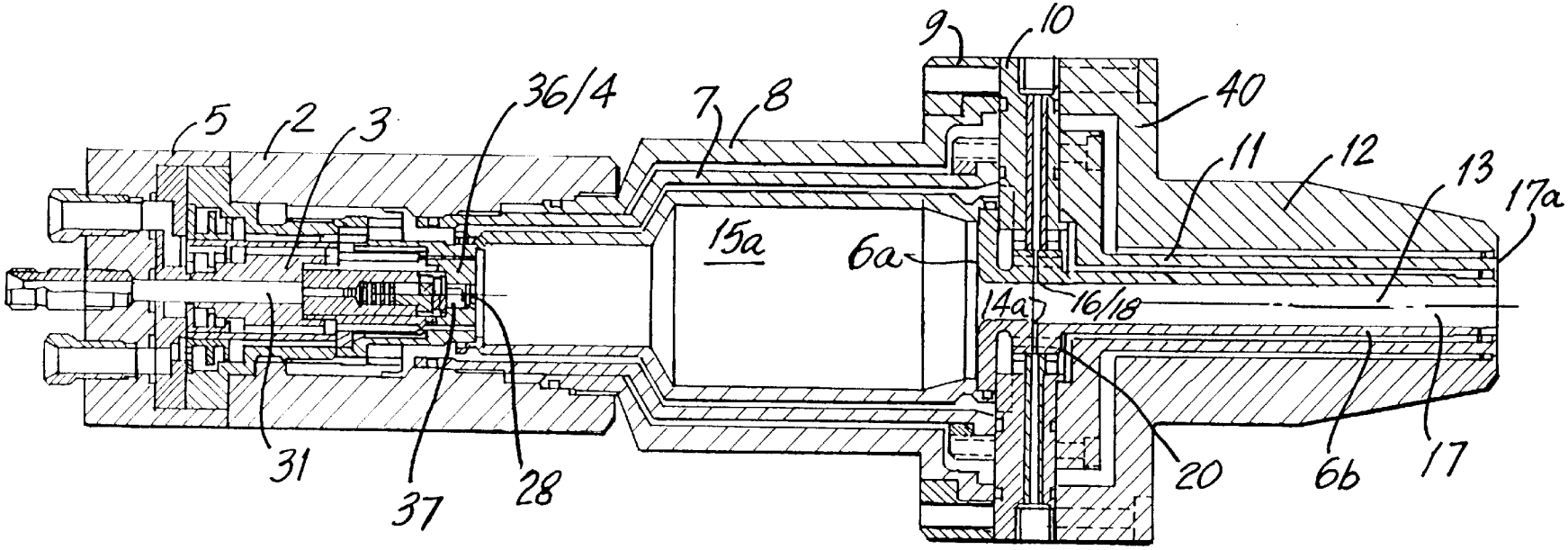
FIG. 10 is a cross-sectional view of a flame spraying burner according to the present invention with a spark device (spark plug) integrated in the mixing block.

The embodiment of a flame spraying burner according to the present invention, which is shown in FIG. 10, includes a spark plug 37 provided in the center 36 of the injection gas mixing block 4. In this embodiment, the spraying material is delivered downstream of the combustion chamber 15*a* through the radial connections 29 provided in the nozzle 6. During the operation of the HVOF-burner 1, the mixture of a fuel gas and oxygen in the chamber 15*a* is ignited electrically. This permits to eliminate an ignition gas mixture for obtaining a pilot flame. Because the ignition takes place in the combustion chamber 15*a* itself, providing a hydrogen-oxygen pilot flame is not needed even when the burner operates on a liquid fuel in association with a compression air or oxygen. Thus, the kerosene-oxygen mixture can be ignited directly in the combustion chamber 15*a*.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of operating a flame spraying burner wherein the burner includes a water-cooled combustion chamber, a rear end block for delivery operating medium components to the combustion chamber, an injection block located downstream of the rear end block and upstream of the combustion chamber for mixing the operating medium components and for injecting the operating medium components mixture into the combustion chamber, a water-cooled expansion nozzle located downstream of the combustion chamber, and means for feeding a spraying material into a center of a flame jet passing through the nozzle, the feeding means comprising means for feeding the spraying material axially through the rear end block and through the combustion chamber and means for delivering the spraying material radially, transversely to a longitudinal axis of the burner, the method comprising the steps of:

operating the flame burner with at least one operating medium component selected from a group consisting of gaseous and liquid fuels and another operating medium component comprising at least one of compressed air and oxygen; and feeding a spraying material through one of the axially feeding means and radially feeding means into the center of the flame jet passing through the nozzle, whereby the material passes out of the nozzle and onto a substrate.

2. A method as set forth in claim 1, wherein the selecting step includes selecting a gaseous fuel as the one operating media component and selecting oxygen as the other operating media component, and wherein the feeding step includes feeding the spraying material through one of the axially feeding means and the radially feeding means.

3. A method as set forth in claim 1, further comprising the step of providing the injection mixing block with means for mixing a liquid fuel with oxygen.

4. A method as set forth in claim 1 further comprising the step of providing a central connector in the rear end block for axially feeding the spraying material, said central connector being used also for feeding hydrogen which is used as a pilot and ignition gas, into the combustion chamber.

5. A method as set forth in claim 4, wherein feeding of hydrogen is effected with a flow pressure of about 5–15 bar.

6. A method as set forth in claim 5, comprising the step of feeding into the burner hydrogen, which is used as a pilot and ignition gas and oxygen, and the step of electrically igniting a hydrogen-oxygen mixture at an outlet of the expansion nozzle.

7. A method as set forth in claim 6, wherein hydrogen and oxygen are fed in predetermined amounts necessary for obtaining a high-speed flame.

8. A method as set forth in claim 7, wherein oxygen is fed in an amount of about 30–60 $m^3$, and hydrogen is fed in an amount of about 15–30 $m^3$.

9. A method as set forth in claim 4, wherein the flame burner operating step includes operating the flame burner using kerosene as a first operating medium component, the method and further comprising the step of cutting off delivery of hydrogen after a flame is ignited.

10. A method as set forth in claim 1, comprising the step of providing the rear end block with a connector for delivering oxygen into the combustion chamber.

11. A method as set forth in claim 10, comprising the step of feeding oxygen through the oxygen connector at a rate of about 25–1000 l/min. with a flow pressure of about 15 bar.

12. A method as set forth in claim 1, wherein the feeding step comprises using a carrier gas for radially feeding the spraying material.

13. A method as set forth in claim 12, wherein the carrier gas is selected from a group consisting of nitrogen, argon and other non-combustible gases.

14. A method as set forth in claim 1, including the step of providing the rear end block with a liquid fuel connector.

15. A method as set forth in claim 1, wherein the group consisting of gaseous and liquid fuels includes liquid kerosene and methane.

16. A method as set forth in claim 1, wherein a liquid fuel is used as an operating medium component, and wherein an injection pressure of a liquid fuel is about from 8 to 15 bar.

17. A method as set forth in claim 1, comprising the step of mixing a liquid fuel and oxygen in the combustion chamber, with injecting the liquid fuel into the combustion chamber in atomized form.

18. A method as set forth in claim 1, wherein the selecting step includes selecting liquid kerosene as the first operational medium component and selecting oxygen as the second operational medium component, the method further comprising the step of introducing a combustible gas into a kerosene-oxygen flame with a spraying material selected from a group consisting of molybdenum and ceramic material.

19. A method as set forth in claim 18, wherein the combustible gas introducing step includes the step of selecting the combustible gas from a group of combustible gases consisting of hydrogen and methane.

20. A method as set in claim 1, further comprising the step of electrically igniting a mixture of the first and second operational medium components in the combustion chamber.

21. A universal high-speed flame spraying burner, comprising:

a combustion chamber;

a rear end block for delivering operating medium components into the combustion chamber, which include at least one operating medium component selected from a group consisting of gaseous and liquid fuels, and another operating media component comprising one of compressed air and oxygen;

an injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising at least one of means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction, wherein the radially feeding means are present, and wherein the water-cooling means comprises an outer water jacket surrounding the expansion nozzle, a flange provided at an end of the water jacket remote from a mouth of the expansion nozzle, and an outer screw sleeve located adjacent to the combustion chamber and provided with a flange ring facing the flange of the outer water jacket, and wherein the radially feeding means comprises a tightening disc secured between the flange and the flange ring.

22. A flame spraying burner as set forth in claim 21, wherein the radial feeding bores are formed in the tightening disc.

23. A flame spraying burner as set forth in claim 22, wherein the expansion nozzle has an axial bore having first and second bore portions and a transition region connecting the first and second bore portions, and wherein the radial feeding bores open into the transition region of the expansion nozzle bore.

24. A flame spraying burner as set forth in claim 23, wherein the transition region between the first and second bore portions is formed by a radial step.

25. A flame spraying burner as set forth in claim 23, wherein the diameter of the second bore portion is larger than the diameter of the first bore portion.

26. A flame spraying burner as set forth in claim 21, wherein the tightening disc comprises cooling channel extending transverse to the radial bores.

27. A flame spraying burner as set forth in claim 21, wherein the tightening disc includes two radially extending sleeves which define the radial feeding bores, respectively.

28. A universal high-speed flame spraying burner, comprising:

a combustion chamber;

a rear end block for delivering operating medium components into the combustion chamber, which include at least one operating medium component selected from a group consisting gaseous and liquid fuels, and another operating media component comprising one of oxidation gases, compressed air and oxygen;

an injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising at least one of means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction, wherein the radially feeding means are present, and wherein the water-cooling means comprises an outer water jacket surrounding the expansion nozzle and having a flange at an end of the water jet remote from a mouth of the expansion nozzle, and an outer screw sleeve located adjacent to the combustion chamber and provided with a flange ring facing the flange of the outer water jacket, wherein the radially feeding means comprises a tightening disc secured between the flange and the flange ring, wherein the radial feeding bores are formed in the tightening disc, wherein the expansion nozzle has an axial bore having first and second bore portions and a transition region connecting the first and second bore portions, and wherein the radial feeding bores open into the transition region of the expansion nozzle bore, wherein the transition region between the first and second bore portions is formed by a radial step, and wherein the radial feeding bores open into an area of the second bore portion bordering the radial step.

29. A universal high-speed flame spraying burner, comprising:

a combustion chamber;

a rear end block for delivering operating medium components into the combustion chamber, which include at least one operating medium component selected from a group consisting gaseous and liquid fuels, and another operating media component comprising one of oxidation gases, compressed air and oxygen;

an injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising at least one of means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction, wherein the radially feeding means are present, and wherein the water-cooling means comprises an outer water jacket surrounding the expansion nozzle and having a flange at an end of the water jet remote from a mouth of the expansion nozzle, and an outer screw sleeve located adjacent to the combustion chamber and provided with a flange ring facing the flange of the outer water jacket, wherein the radially feeding means comprises a tightening disc secured between the flange and the flange ring, wherein the radial feeding bores are formed in the tightening disc, wherein the expansion nozzle has an axial bore having first and second bore portions and a transition region connecting the first and second bore portions, and wherein the radial feeding bores open into the transition region of the expansion nozzle bore, and wherein the expansion nozzle includes a cylindrical collar in a region thereof in which the radial feeding bores open into the nozzle bore.

30. A flame spraying burner as set forth in claim 29, wherein the tightening disc is supported on the collar, wherein the collar has channel means through which cooling water flows, and wherein sealing elements are provided on opposite sides of the radical feeding bores in a contract area of the tightening disc with the collar.

31. A flame spraying burner as set forth in claim 30, wherein the sealing elements are formed as O-rings.

32. A flame spraying burner as set forth in claim 30, wherein the channel means comprises a plurality of axial bores.

33. A universal high-speed flame spraying burner, comprising:

a combustion chamber;

a rear end block for delivering operating medium components into the combustion chamber, which include at least one operating medium component selected from a group consisting of gaseous and liquid fuels, and another operating media component comprising one of compressed air and oxygen;

an injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising at least one of means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction, wherein the axially feeding means comprises a tube, and wherein the rear end block includes two separate connectors for delivering and discharging cooling water for cooling the tube, the water cooling means for cooling the tube comprising means for cooling at least a portion of the tube projecting into the combustion chamber.

34. A flame spraying burner as set forth in claim 33, wherein the tube extends into the combustion chamber.

35. A flame spraying burner as set forth in claim 34, wherein the tube extends up to a vicinity of a bore of the expansion nozzle.

36. A flame spraying burner as set forth in claim 34, wherein the tube includes means for water-cooling the same.

37. A universal high-speed flame spraying burner, comprising:

a combustion chamber;

a rear end block for delivering operating medium components into the combustion chamber, which include at least one operating medium component selected from a group consisting of gaseous and liquid fuels, and another operating media component comprising at least one of compressed air and oxygen;

a injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising at least one of means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction, wherein the rear end block is provided with a connector for introducing at least one of a cooling gas and a protective gas into the combustion chamber when a fuel-oxidation gas mixture is used for combustion, for varying combustion parameters.

38. A universal high-speed flame spraying burner, comprising:

a combustion chamber;

a rear end block for delivering operating medium components into the combustion chamber, which include at least one operating medium component selected from a group consisting of gaseous and liquid fuels, and another operating media component comprising one of compressed air and oxygen;

an injection block located downstream of the rear end block and upstream of the combustion chamber for mixing the operating medium components and for injecting the operating medium component mixture into the combustion chamber, an expansion nozzle located downstream of the combustion chamber;

means for water-cooling of the combustion chamber and of the expansion nozzle; and means for feeding a spraying material into a center of a flame jet passing through the nozzle, the feeding means comprising means for feeding the spraying material axially through the rear end block and through the combustion chamber and means for feeding the spraying material radially, transverse to a longitudinal axis of the burner, the radially feeding means comprising at least two opposite radial feeding bores located downstream of the combustion chamber in a spraying direction.

39. A flame spraying burner as set forth in claim 38, wherein all of components of the burner form part of a set of exchangeable burner components.

40. A flame spraying burner as set forth in claim 38, wherein the injection mixing block comprises a plurality of metering bores provided in an injection region of the mixing block.

41. A flame spraying burner as set forth in claim 15, wherein the combustion chamber is formed as one of a one-stage chamber and a two-stage chamber.

42. A flame spraying burner as set forth in claim 38, further comprising a spark plug provided in a center of the injection mixing block.

* * * * *